US006026551A

United States Patent [19]

Honsel et al.

[11] Patent Number: 6,026,551

[45] Date of Patent: Feb. 22, 2000

[54] RIVETING APPARATUS

[75] Inventors: Michael H. Honsel, Froendenberg, Germany; Dallas B. Perkins, Seminole, Fla.

[73] Assignees: M.H. Honsel Beteiligungs GmbH, Germany; Sartam Industries, Inc.

[21] Appl. No.: 09/249,245

[22] Filed: Feb. 11, 1999

[30] Foreign Application Priority Data

Feb. 13, 1998 [DE] Germany ..... 198 06 051

[51] Int. Cl.[7] ..... B21J 15/04; B21J 9/14

[52] U.S. Cl. ..... 29/243.521; 72/454; 72/452.5

[58] Field of Search ..... 29/243.521, 243.527; 72/453.15, 453.17, 391.4, 454

[56] References Cited

U.S. PATENT DOCUMENTS 5,272,811 12/1993 Armand ..... 72/453.15

5,553,478 9/1996 Di Troia ..... 72/453.15

FOREIGN PATENT DOCUMENTS

527414-A1 2/1993 European Pat. Off. ..... 29/243.521

*Primary Examiner*—David Jones

*Attorney, Agent, or Firm*—Majestic, Parsons, Siebert & Hsue; Grunecker, Kinkeldey, Stockmair & Schwanhausser

[57] ABSTRACT

The present invention relates to a riveting apparatus having a power supply unit (20), which is replaceable or exchangeable, attached to the riveting apparatus, said power supply unit having a preferably rechargeable battery and the riveting apparatus being adapted to be brought into an operative condition by attaching the power supply unit at the riveting apparatus, and comprising a rivet pin collecting compartment (12) comprising at least one closeable discharge opening (13). In order to ensure that the riveting apparatus is operated at closed rivet pin collecting compartment only, it is provided according to the invention that in the operative condition of the riveting apparatus the power supply unit forms a cover that closes the discharge opening.

15 Claims, 1 Drawing Sheet

RIVETING APPARATUS

BACKGROUND OF THE INVENTION

The present invention relates to a riveting apparatus having a power supply, which is replaceable or exhangeable, unit attachable to the riveting apparatus.

Riveting apparatus of that kind are generally known from the prior art. They are used to apply, for instance, blind rivets. The electrically operated drive mechanism of the riveting apparatus is supplied by the power supply unit. Riveting apparatus of that kind may be portably operated since they have an exchangeable power supply unit. They are in particular suitable for use on construction sites, where sufficient power supply often does not exist. In industrial use of riveting apparatus of that kind, the exchangeable power supply unit also proves to be advantageous. Since the riveting apparatus are operated by hand, power cables being disadvantageous in handling the riveting apparatus are dispensable. Hence, riveting apparatus of that kind are in particular suitable for use in installation, especially that are not easily accessible components, such as vehicular chassis on production lines.

The rivet pin collecting compartment shall prevent rivet pins falling out of the riveting apparatus after setting the rivet. The rivet pin collecting compartments are usually attached to the riveting apparatus by the operator. Since the rivet pins have sharp edges, they are a severe risk of injury. When used on production lines, it proved that the operators frequently do not attach the collecting compartments to the riveting apparatus. Thus, the rivet pins fall onto the ground of the working station. This may lead to injuries. It may also occur that the rivet pins remain in the workpiece to be mounted, such as a vehicular chassis etc., which may lead to undesired rattling after installation. Usually, the installed object must be disassembled then in order to remove the rivet pin.

SUMMARY OF THE INVENTION

It is the object of the invention to improve the riveting apparatus of the above-mentioned kind in a manner that the rivet pins are reliably collected by the rivet pin collecting compartment.

The object of the invention is solved in that the power supply unit forms a cover, at least during the operative condition, wherein said cover closes the discharge opening.

This solution is simple, and has the advantage that in the operative condition of the riveting apparatus, the discharge opening is automatically closed, so that the rivet pins are reliably collected in the rivet pin collecting compartment. If the power supply unit is not attached to the riveting apparatus, the riveting apparatus cannot be operated. As soon as the power supply unit is attached to the riveting apparatus, the discharge opening is at the same time closed. In this manner, it is always ensured that the rivet pin collecting compartment is closed when the riveting apparatus is in an operative condition. Thus, the risk of injury caused by rivet pins lying around can be reduced and at the same time it can be prevented that rivet pins unintentionally fall into the objects to be joined by means of rivets.

In an advantageous development, the riveting apparatus may have terminals communicating with terminals of the power supply unit during the operative condition of the riveting apparatus. Thereby the function of the invention can additionally be ensured. Only in the operative condition does a contact exist between the terminals of the power supply unit and the terminals at the riveting apparatus.

In order to provide the riveting apparatus in a more compact manner, the rivet pin collecting compartment may be formed integrally with a housing of the riveting apparatus. This also prevents the rivet pin collecting compartment from not being attached to the riveting apparatus by the operator. It is ensured by the design integral with the housing that the rivet collecting compartment is always attached to the riveting apparatus.

The power supply means for attachment to the riveting apparatus may advantageously be insertable into the housing. This increases the operating convenience. The operative condition may be established by simply plugging the power supply unit into the riveting apparatus.

It is an advantage if the housing has a handle and if the power supply unit is insertable into the handle. In this way, the rivet apparatus can be designed especially compact. It is an advantageous development if the handle has a receptacle into which a substantially pin-shaped projection of the power supply unit is insertable. In this way, the riveting apparatus can easily be designed especially stable.

In order to give the riveting apparatus a more compact design, it can be an advantage if the power supply unit is arranged underneath the rivet pin collecting compartment when operating the riveting apparatus. Since the power supply unit is usually quite heavy compared to the riveting apparatus, the handling of the riveting apparatus can also be simplified.

It can also be an advantage if, during operation of the riveting apparatus, the power supply unit forming the cover forms at least a portion of the bottom of the rivet pin collecting compartment. In this way, the rivet pin collecting compartment can be easily emptied by removing the power supply unit. Gravity then causes the rivet pins to fall down through the discharge opening of the rivet pin collection equipment.

It can also be an advantage if the cover or the bottom are formed by a housing of the power supply unit. If the power supply unit comprises such a housing, its shape can be adapted in a better way to the shape of the riveting apparatus. Moreover, the batteries can be arranged within the housing where they are protected.

In order to ensure a safe collection of the rivet pins during operation of the riveting apparatus, the rivet pin collecting compartment may be arranged underneath a ties spindle of the riveting apparatus during operation of same. Gravity then causes the rivet pins to automatically fall into the rivet pin collecting compartment.

In an advantageous embodiment of the invention, the housing may be formed as a hollow body which confines the rivet pin collecting compartment at least section-wise. Then the rivet pin collecting compartment can be formed integrally with the housing. In this way, it can be prevented that the riveting apparatus is operated without the rivet pin collecting apparatus.

It can also be an advantage if the housing of the power supply unit comprises a front face section forming the bottom or cover and extending substantially perpendicularly to the projection of the power supply unit. In this way, the housing of the power supply unit can have a simple geometric shape. Moreover, the discharge opening of the rivet pin collecting compartment can be easily closed by simply inserting the projection of the power supply unit into the receptacle. It is then also easy to open the rivet pin collecting compartment by simply pulling out the power supply unit.

In an advantageous embodiment of the invention, it may prove to be advantageous if the rivet pin collecting compartment opens into the receptacle. Thereby material for the manufacture of the housing of the riveting apparatus may be saved. Further, the discharge opening of the rivet pin collecting compartment may be enlarged, since said discharge opening also joins the projection of the power supply unit, and the projection of the power supply unit in this way also closes a portion of the rivet pin collecting compartment.

In order to give the riveting apparatus an especially compact design, it may prove to be an advantage if the rivet pin collecting compartment and the handle converge towards the power supply unit. In this way, the riveting apparatus can be designed in an especially simple manner.

In an advantageous embodiment of the invention, at least one locking means may be provided by which the power supply unit can be secured at the housing during the operative condition of the apparatus. In this way, it can be prevented that the rivet pin collecting compartment is unintentionally opened in that the power supply unit falls off the handle.

The invention will now be described in detail by means of an embodiment. Additional objects, features and advantages of various aspects of the present invention will become apparent from the following description of its preferred embodiments, which description should be taken in conjunction with the accompanying drawings.

DETAILED DESCRIPTION OF THE DRAWINGS

Figure 1:
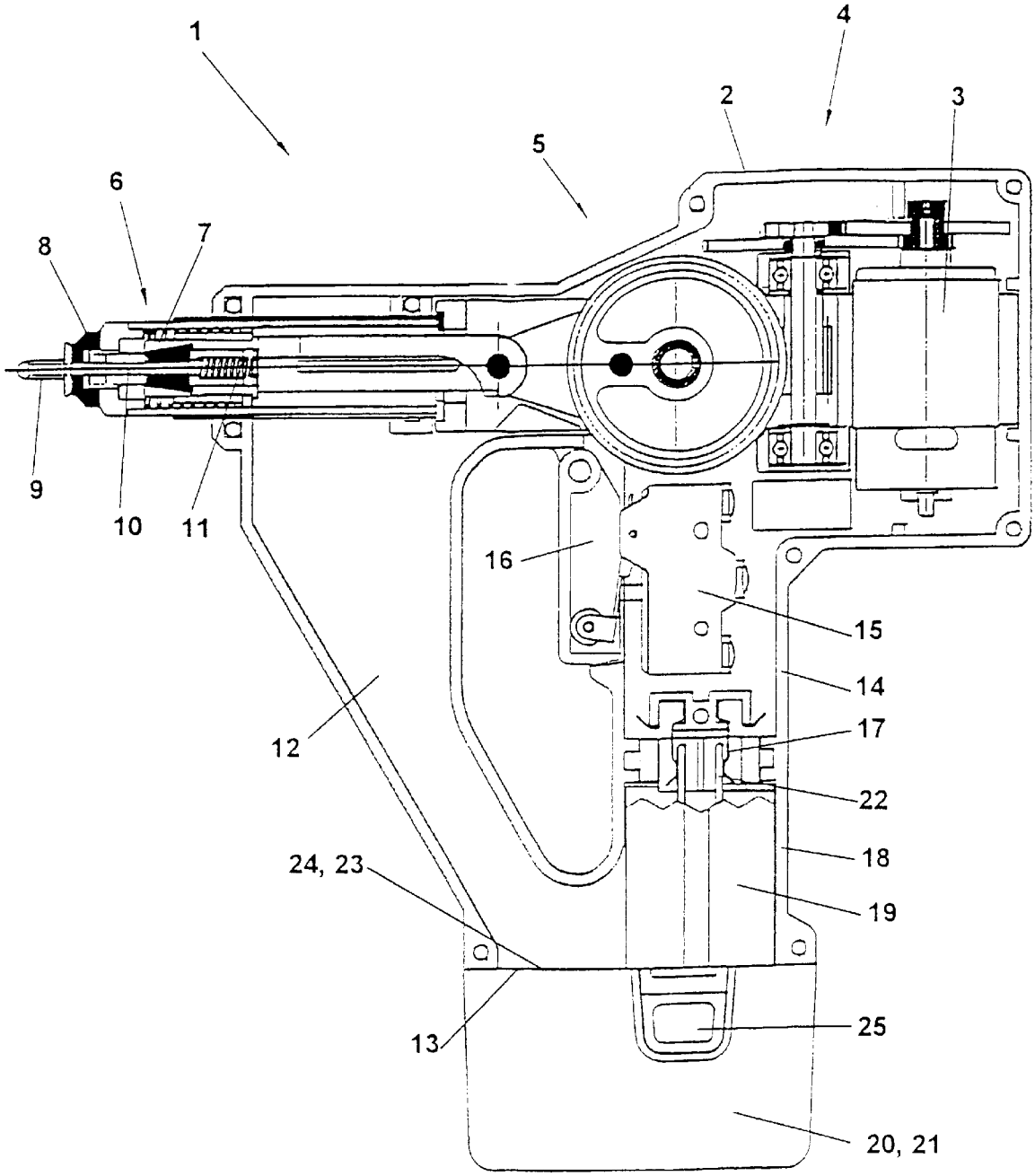
FIG. 1 shows a sectional view of a preferred embodiment of the riveting apparatus according to the present invention.

The present invention relates to a riveting apparatus having a power supply unit, which is replaceable or exchangeable, attachable to the riveting apparatus, said power supply unit having at least one preferably rechargeable battery, the riveting apparatus being put into an operative condition when attaching the power supply unit to the riveting apparatus, and having a rivet pin collecting compartment comprising at least one closeable discharge opening.

FIG. 1 shows in a sectional view a riveting apparatus 1 according to the invention.

The riveting apparatus 1 has a housing 2 in which a drive motor 3 is arranged. The drive motor 3 is an electromotor, driving a crank mechanism 5 via a gearing 4, said crank mechanism 5 driving a riveting means 6. The riveting means 6 has a tie spindle 7, which is not shown in detail. FIG. 1 shows a sectional view of a mouth piece 8 of the riveting means. A rivet 9 is situated in the mouth piece 8. The rivet 9 shown in FIG. 1 is not installed yet. A rivet pin 10 extends into the mouth piece 8. The tie spindle 7 has a through hole 11 through which the rivet pin 10 after being torn off may penetrate and fall into the interior of the housing 2 of the riveting apparatus 1.

The arrangement consisting of the drive motor 3, the gearing 4, the crank mechanism 5 and the riveting means 6 operates in the known manner and is therefore not explained any closer.

The housing 2 has a rivet pin collecting compartment 12. This compartment 12 is formed integrally with the housing 2. The rivet pin collecting compartment 12 has a discharge opening 13. The housing 2 moreover comprises a handle 14 in which a push-button switch 15 is received that is operable by a button 16. Moreover, terminals 17 are arranged within the handle 14. The terminals 17 communicate with the push-button switch 15 and the drive motor 3 through electric lines that are not shown in detail. Moreover, a receptacle 18 is provided in the handle 14 into which a pin-like projection 19 of a power supply unit 20 can be inserted.

The power supply unit 20 has a housing 21 which also forms the pin-like projection 19. Moreover, terminals 22 are attached at the pin-like projection 19 of the housing 21, said terminals 22 communicating with the terminals 17 when the pin-like projection 19 is arranged in the receptacle 18.

Rechargeable batteries, which are not shown in detail, are arranged within the housing 21 of the power supply unit 20. These batteries communicate with the terminals 22. Through the terminals 17 and 22, the batteries can be brought into electric contact with the drive motor 3 by operating the button 16 and thus also the push-button switch 15, so that the drive motor 3 can be supplied in a known manner with current from the batteries.

The housing 21 of the power supply unit 20 moreover has a front face 23 extending substantially perpendicular to the longitudinal extension of the pin-like projection 19. This front face 23 at the same time forms a cover 24 for the rivet pin collecting compartment 12.

This cover 24 at the same time further forms a bottom for the rivet pin collecting compartment 12, since during operation of the riveting apparatus 1, the power supply unit 20 is arranged underneath the rivet pin collecting compartment 12.

As can be easily seen in FIG. 1, the discharge opening 13 of the rivet pin collecting compartment 12 and the receptacle 18 open into a common plane which extends in the plane of the front face 23 of the power supply unit 20 when the power supply unit 20 is plugged-in.

The power supply unit 20 can be attached at the riveting apparatus 1 in a manner that the power supply unit can be exchanged and removed. It can be easily installed by simply plugging the pin-like projection 19 into the receptacle 18 in the riveting apparatus 1. The plug-in causes the terminals 22 and 17 to be brought into electric contact. The power supply unit 20 can be easily removed from the riveting apparatus 1 by simply pulling it out. A partially-shown safety device 25 having safety brackets ensures that the inserted power supply unit 20 does not accidentally fall out of the riveting apparatus 1.

By inserting the power supply unit 20 into the housing 2 of the riveting apparatus 1, not only an electric contact is established between the terminals 22 and 17, but at the same time the discharge opening 13 is closed by the front face 23.

Now the function of the invention will be explained in detail.

In order to put the riveting apparatus 1 into operation, the pin-like projection 19 of the power supply unit 20 is inserted into the receptacle 18. This causes the terminals 22 and 17 to get into contact. The batteries of the power supply unit 20 accommodated in the housing 21 of the power supply can supply the drive motor 3 with electric current.

In the plugged-in condition of the power supply unit 20, the push-button switch 15 can be operated by operating the button 16 by the hand of an operator holding the handle 14, said push-button switch 15 establishing an electric communication between the batteries and the drive motor 3. The drive motor 3 can set the rivet 9 in the known manner through the gearing 4 and the crank mechanism 5 and the riveting means 6.

By inserting the power supply unit 20 into the housing 2 of the riveting apparatus 1, the rivet pin collecting compartment 12 is at the same time closed in that the discharge opening 13 is closed by the front face 23. During operation, torn-off rivet pins such as the rivet pin 10 fall through the through-hole 11 into the rivet pin collecting compartment 12. The rivet pins are collected there.

As soon as the rivet pin collecting compartment 12 is filled, it can be opened by pulling the power supply unit 20 out of the handle 20, so that the collected rivet pins 10 fall out of the rivet pin collecting compartment 12 to be, for instance, disposed of Moreover, the rivet pin collecting compartment 12 is dimensioned in a manner that it can receive an amount of rivet pins that approximately corresponds to the amount of rivets that can be set by the power capacity of the power supply unit 20.

It is ensured by the riveting apparatus 1 according to the invention that in an operative riveting apparatus, i.e. when the power supply unit 20 is inserted, the rivet pin collecting compartment 12 is at the same time closed by the cover 24.

In the operative condition, i.e. when the power supply unit 20 is arranged within the riveting apparatus 1, it is an advantage that the power supply unit 20 is arranged underneath the rivet pin collecting compartment 12 and underneath the drive motor 3, the gearing 4, the crank mechanism 5 and the riveting means 6. The handle 14 is arranged between the power supply unit 20 and the drive motor 3. Since the power supply unit 20, the drive motor 3, the gearing 4, the crank mechanism 5 and the riveting means 6 are relatively heavy components, a better weight distribution of the riveting apparatus 1 above and below the handle 14 can be achieved. This improves the handling comfort of the riveting apparatus 1.

It is to be understood that while the invention has been described above in conjunction with preferred specific embodiments, the description and examples are intended to illustrate and not limit the scope of the invention, which is defined by the scope of the appended claims.

What is claimed is:

1. A riveting apparatus comprising:

a power supply unit (2) attached to the riveting apparatus, said power supply unit exchangeable and having a battery, the riveting apparatus being adapted to be brought into an operative condition by attaching the power supply unit to the riveting apparatus; and a rivet pin collecting compartment (12) comprising at least one closeable discharge opening (13), characterized in that the power supply unit forms a cover (24) at least in the operative condition, said cover closing the discharge opening.

2. A riveting apparatus as claimed in claim 1, characterized in that the riveting apparatus comprises terminals (17) communicating with terminals (22) of the power supply unit when the riveting apparatus is in the operative condition.

3. A riveting apparatus as claimed in claim 1 or 2, characterized in that the rivet pin collecting compartment (12) is formed integrally with a housing (2) of the riveting apparatus.

4. A riveting apparatus as claimed in claim 1, characterized in that the power supply unit can be inserted into a housing of the riveting apparatus for attachment to the riveting apparatus.

5. A riveting apparatus as claimed in claim 1, characterized in that a housing of the riveting apparatus has a handle (14) and the power supply unit can be inserted into the handle.

6. A riveting apparatus as claimed in claim 1, characterized in that a handle of a housing of the riveting apparatus has a receptacle (18) into which a projection (19) of the power supply unit can be inserted.

7. A riveting apparatus as claimed in claim 1, characterized in that the power supply unit is arranged underneath the rivet pin collecting compartment during operation of the riveting apparatus.

8. A riveting apparatus as claimed in claim 1, characterized in that during operation of the riveting apparatus, the power supply unit forming the cover forms at least a portion of a bottom of the rivet pin collecting compartment.

9. A riveting apparatus as claimed in claim 1, characterized in that the cover is formed by a housing of the power supply unit.

10. A riveting apparatus as claimed in claim 1, characterized in that the rivet pin collecting compartment is arranged underneath a tie spindle (7) of the riveting apparatus during operation of the riveting apparatus.

11. A riveting apparatus as claimed in claim 1, characterized in that a housing of the riveting apparatus is formed as a hollow body, said housing at least confining a section of the rivet pin collecting compartment.

12. A riveting apparatus as claimed in claim 1, characterized in that a housing of the power supply unit comprises a front face section forming a bottom of the riveting collecting compartment or the cover and extending substantially perpendicularly to the projection of the power supply unit.

13. A riveting apparatus as claimed in claim 1, characterized in that the rivet pin collecting compartment opens into a receptacle.

14. A riveting apparatus as claimed in claim 1, characterized in that the rivet pin collecting compartment and a handle of the housing of the riveting apparatus converge towards the power supply unit.

15. A riveting apparatus as claimed in claim 1, characterized in that at least one locking means is provided.

* * * * *